US006381419B1

(12) United States Patent
Kinoshita et al.

(10) Patent No.: US 6,381,419 B1
(45) Date of Patent: Apr. 30, 2002

(54) IMAGE FORMING APPARATUS WITH DEVELOPER DENSITY AND DEVELOPER REMAINING AMOUNT DETECTION FEATURES

(75) Inventors: Masahide Kinoshita; Koichi Hiroshima, both of Shizuoka-ken; Hironobu Isobe; Ryuichi Yoshizawa, both of Numazu, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/588,735

(22) Filed: Jun. 7, 2000

(30) Foreign Application Priority Data

Jun. 10, 1999 (JP) ..... 11-163669

(51) Int. Cl.[7] ..... G03G 15/08
(52) U.S. Cl. ..... 399/27; 399/30; 399/106
(58) Field of Search ..... 399/27, 28, 29, 399/30, 58, 59, 61, 62, 63, 64, 106, 253, 254, 255, 258, 259, 260, 262, 263

(56) References Cited

U.S. PATENT DOCUMENTS 5,142,325 A * 8/1992 Kai et al. ..... 399/27
5,253,020 A * 10/1993 Matsushita et al. ..... 399/27

FOREIGN PATENT DOCUMENTS

| | | |
|---|---|---|
| EP | 0 302 415 A2 | 2/1989 |
| EP | 0 503 543 A2 | 9/1992 |

* cited by examiner

*Primary Examiner*—Sophia S. Chen
*Assistant Examiner*—Huang Ngo
(74) *Attorney, Agent, or Firm*—Fitzpatrick, Cella, Harper & Scinto

(57) ABSTRACT

An image forming apparatus has a developing device for developing an electrostatic image formed on an image bearing member by a developer. A developer supplying unit is detachably attachable to a main body of the image forming apparatus and supplies the developer to the developing device. A density detecting device detects a density of the developer in the developing device. A developer remaining amount detecting device detects information regarding an amount of the developer in the developing supplying unit. A state of the developer supplying unit is judged on the basis of a result of the detection by the density detecting device and a result of the detection by the second detecting device.

30 Claims, 7 Drawing Sheets

IMAGE FORMING APPARATUS WITH DEVELOPER DENSITY AND DEVELOPER REMAINING AMOUNT DETECTION FEATURES

BACKGROUND OF THE INVENTION

1. Field of the Invention

This invention relates to an image forming apparatus such as an electrophotographic apparatus.

Herein, the image forming apparatus is an apparatus using, for example, the electrophotographic image forming method to form an image on a recording medium, and covers, for example, an electrophotographic copier, an electrophotographic printer (such as a laser printer or an LED printer), a facsimile apparatus and a wordprocessor.

2. Related Background Art

In an image forming apparatus using the electrophotographic image forming process, there has heretofore been adopted the process cartridge system in which an electrophotographic photosensitive body which is an image bearing member and process means acting on this electrophotographic photosensitive body are integrally made into a cartridge which is detachably attachable to the main body of the image forming apparatus. According to this process cartridge system, the maintenance of the apparatus can be done by a user himself without resorting to a serviceman and therefore, operability can be markedly improved. So, this process cartridge system is widely used in image forming apparatuses.

The above-described process cartridge system, however, is limited in developer capacity, i.e., toner capacity, and has the following weak points.

Particularly in the case of an image forming apparatus capable of effecting heavy duty printing, the process cartridge system having a small toner capacity increases the frequency of interchange of the process cartridge and usability becomes bad. Also, besides the toner, the constituent parts of the cartridge are also integrally interchanged, and this results in the rise of running cost.

So, the so-called toner replenishing system in which an apparatus such as developing means is provided on the main body side of an image forming apparatus and only a toner is supplied has become the mainstream in the image forming apparatuses capable of effecting heavy duty printing. The demerit of this toner replenishing system is that the maintenance such as the interchange of parts of consumption is almost impossible by the user and the maintenance by a serviceman is necessary.

Under the present situation as noted above, in recent years, there is being realized a toner replenishing system process cartridge system having the merits of the process cartridge system and the toner replenishing system.

This system is comprised of a process cartridge having a photosensitive drum which is an electrophotographic photosensitive body, and developing means for visualizing an electrostatic latent image formed on the photosensitive drum by a toner, a developer supplying unit, i.e., a toner supplying unit, for replenishing the developing means with a predetermined amount of toner.

This developing means has a toner density detecting device as developer density detecting means for detecting the density of the developer therein (the density of the toner), i.e., the mixing ratio of toner and carrier, and effects the toner replenishment from the toner supplying unit in conformity with the detected value by this toner density detecting device, thereby maintaining the density of the toner constant.

Also, the developing means has means for detecting the amount of toner in the toner supplying unit, and as this detecting means, use is made of one of various conventional sensors such as a piezo-sensor provided on the inner wall of a container, a sensor for detecting the amount of toner from the electrostatic capacity of the toner, and a light transmitting type sensor.

The toner supplying unit comprises a toner enclosing portion and a toner supplying portion, and is provided with a construction for sealing the toner by a seal member to prevent the leakage of the toner during distribution (transportation). The user moves or pulls out the seal member when he uses the toner supplying unit for the first time, thereby making the supply of the toner from the toner supplying portion.

By applying such a toner replenishing system process cartridge to an electrophotographic image forming apparatus, maintenance property, improved usability, low running cost, etc. are realized.

The toner supplying unit must be used after the seal member which has so far sealed the toner has been pulled out or moved during use. In the above-described example of the prior art, however, the amount of toner in the toner supplying unit can be detected, but it cannot be detected that the toner is in its suppliable state.

Therefore, if the image forming operation is performed when the seal member has not been pulled out or moved and the toner is not in its suppliable state, the replenishment of the developing means with the toner is not effected at all in spite of it being detected that a sufficient amount of toner is present in the toner supplying unit, thus resulting in a reduction in image density.

Also when due to some accident or other, the replenishment of the toner supply from the toner supply port of the toner supplying unit is not effected well, it is impossible to detect this, thus likewise resulting in a reduction in image density.

SUMMARY OF THE INVENTION

Accordingly, it is an object of the present invention to provide an image forming apparatus which reliably judges the forgetting of the pulling out of a seal member when a developer supplying unit is a new one, the bad opening and closing of the seal member, and further the state of the developer supplying unit as when the replenishment of the developer supply has not been sufficiently effected for some reason or other, can inform a user of these and is very useful to a user.

Other objects and features of the present invention will become more fully apparent from the following detailed description when read with reference to the accompanying drawings.

DESCRIPTION OF THE PREFERRED EMBODIMENTS

An electrophotographic image forming apparatus and a developer supplying unit according to the present invention will hereinafter be described in greater detail with reference to the drawings.

Embodiment 1

A color laser printer utilizing the electrophotographic process which is an electrophotographic image forming apparatus according to a first embodiment of the present invention will first be described with reference to FIG. 1.

Figure 1:
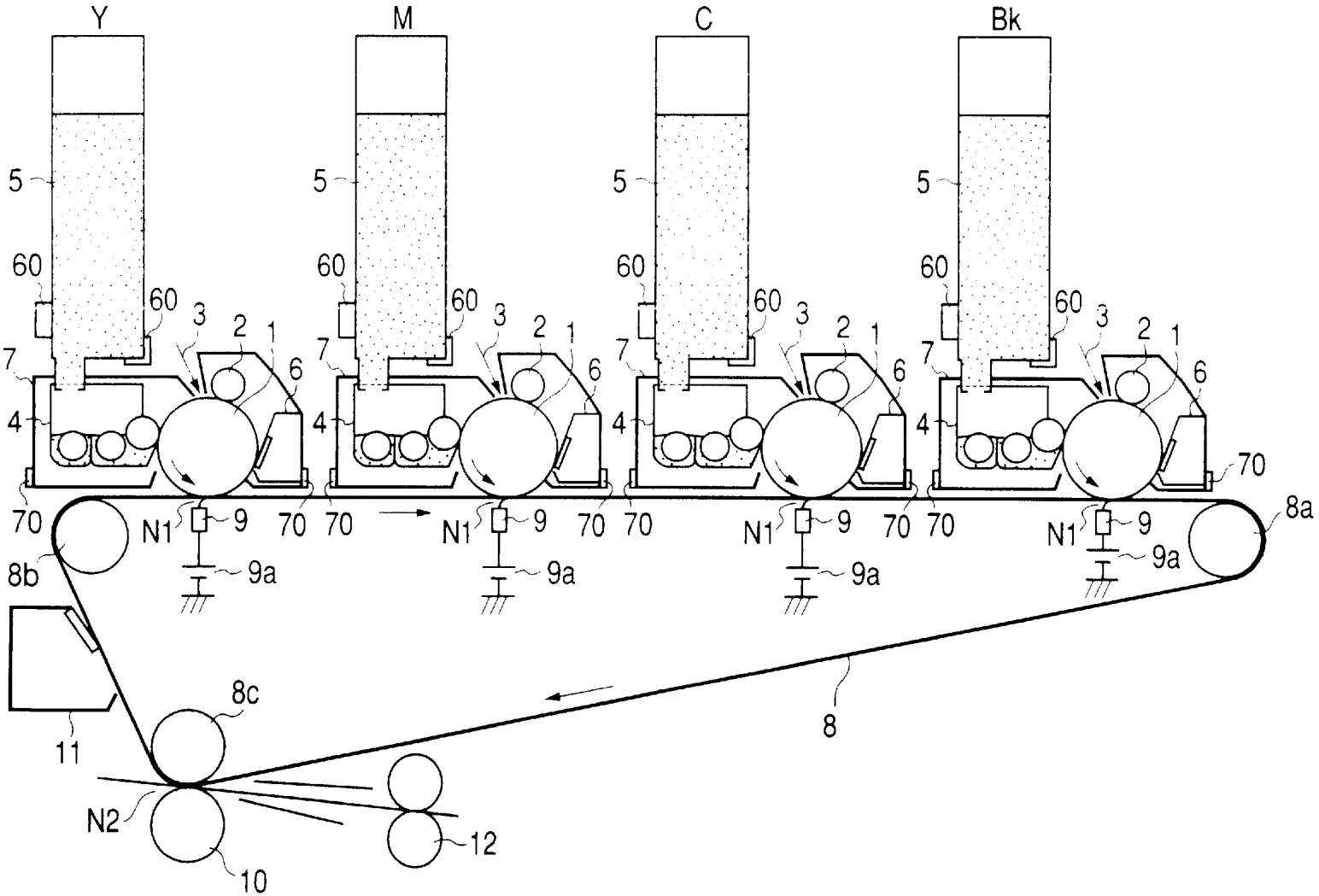
FIG. 1 schematically shows the construction of a color laser printer according to an embodiment of the present invention.

The color laser printer shown in FIG. 1 is a four-set drum type (in-line) printer which has four process cartridges 7 and which once continuously multiplexly transfers images formed on electrophotographic photosensitive bodies (hereinafter referred to as the "photosensitive drums") 1 as first image bearing members by the respective process cartridges 7 onto an intermediate transferring belt 8 which is a second image bearing member, and obtains a full color print image.

In FIG. 1, the endless intermediate transferring belt 8 is passed over a driving roller 8*a*, a tension roller 8*b* and a secondary transferring opposed roller 8*c*, and is rotated in the direction of arrow "A".

The four process cartridges (hereinafter referred to as "P-CRG's") 7 are disposed in series along the horizontal plane of the intermediate transferring belt 8 correspondingly to four colors, i.e., yellow Y, magenta M, cyan C and black Bk.

P-CRG's 7 will hereinafter be described. The P-CRG's 7 differ from one another in the colors of toners to which they are directed, but have the same structure and therefore, their constituent members are given the same reference numerals.

The photosensitive drum 1 provided in the P-CRG 7 disposed at the most upstream side with respect to the direction of movement of the intermediate transferring belt 8 for developing with the yellow toner is uniformly charged to a predetermined polarity and potential in its rotated process by a primary charging roller 2 which is charging means, and then is subjected to image exposure 3 by image exposing means (such as a color resolving and imaging exposure optical system for a colored original image, or a scanning exposure optical system by laser scan outputting a laser beam modulated correspondingly to the time-serial electrical digital pixel signal of image information), not shown, whereby there is formed an electrostatic latent image corresponding to a first color component image (yellow component image) of a desired color image.

The electrostatic latent image is then developed by a first developing device (yellow developing device) 4 with a yellow toner which is a first color.

The developing device 4 which is developing means will now be described with reference to FIGS. 2 and 3.

The developing device 4 is a two-component contact developing device (two-component magnetic brush developing device), and holds a developer comprising a carrier and a toner on a developing sleeve 41 containing a magnet roller therein. A developer regulating blade 42 is provided with a predetermined gap with respect to the developing sleeve 41, and forms a thin developer layer on the developing sleeve 41 with the rotation of the developing sleeve 41 in the direction of arrow C.

The developing sleeve 41 is disposed so as to have a predetermined gap with respect to the photosensitive drum 1, and is set so that during development, the thin developer layer formed on the developing sleeve 41 can develop while keeping contact with the photosensitive drum 1.

The toner used in the present embodiment is a negatively charged toner having an average particle diameter of 6 $\mu$m, and a magnetic carrier having saturated magnetization of 205 emu/cm$^3$ ($205\times4\pi\times10^{-4}=820\pi\times10^{-4}$ Wb/m$^2$) and an average particle diameter 35 $\mu$m was used as the carrier. Also, a mixture of the toner and the carrier at a weight ratio of 6:94 was used as the developer.

The developing device 4 has the lower portion of its interior divided into two by a partition plate 4*a*, and first and second agitating screws 43 and 44 for agitating the developer are disposed therein, and the first and second agitating screws 43 and 44 are rotated in synchronism with the rotation of the developing sleeve 41 to thereby agitate the supplied toner and carrier and give predetermined triboelectricity. As shown in FIG. 3, the developer is circulated in the directions of arrows with the rotation of the first and second agitating screws 43 and 44. That is, the developer is carried from the inner part side of the developing device 4, i.e., the side of a group of gears 49 for driving the developing sleeve 41 and the first and second agitating screws 43 and 44 to this side and is shifted from an opening portion 4*b* provided on this side of the partition plate 4*a* to the second agitating screw 44 side by the first agitating screw 43, and then is sent from this side of the developing device 4 to the inner part side thereof, and is moved from an opening portion 4*c* on the inner part side of the partition plate 4*a* to the first agitating screw 43 side by the second agitating screw 44.

A toner density sensor 45 for detecting a variation in the magnetic permeability of the developer to thereby detect the density of the toner in the developer is provided on the wall surface of the developing device 4 at the upstream side of the second agitating screw 44 with respect to the direction of movement of the developer, and a toner replenishing opening 46 is provided somewhat downstream of this toner density sensor 45.

After the developing operation has been performed, the developer is carried to the vicinity of the toner density sensor 45, and the density of the toner in the developer is detected by the sensor 45, and in order to maintain the density of the toner in the developer constant in conformity with the result of the detection, the replenishment of the toner supply is suitably effected from the toner supply port of a toner supplying unit (hereinafter referred to as "T-CRG") 5 which is a developer supplying unit through the opening 46 in the developing device 4. The toner supplied for replenishment is carried in the direction of arrow "C" by the second agitating screw 44 and is given moderate triboelectricity while mixing with the carrier, whereafter it is carried to the vicinity of the developing sleeve 41, and is formed into a thin layer on the developing sleeve 41 and is used for development.

Figure 2:
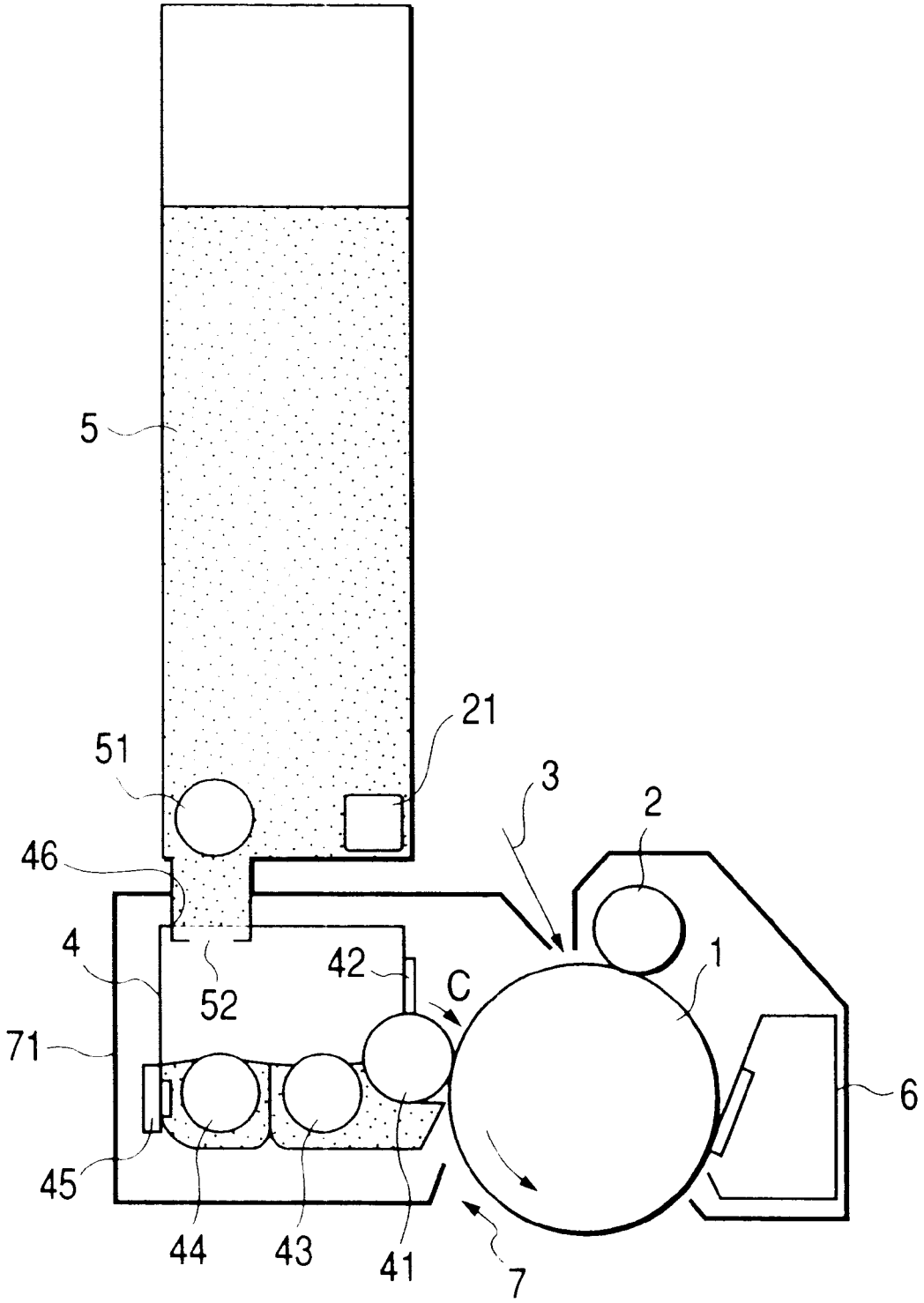
FIG. 2 shows the constructions of a process cartridge and a toner supplying unit according to an embodiment of the present invention.
Figure 3:
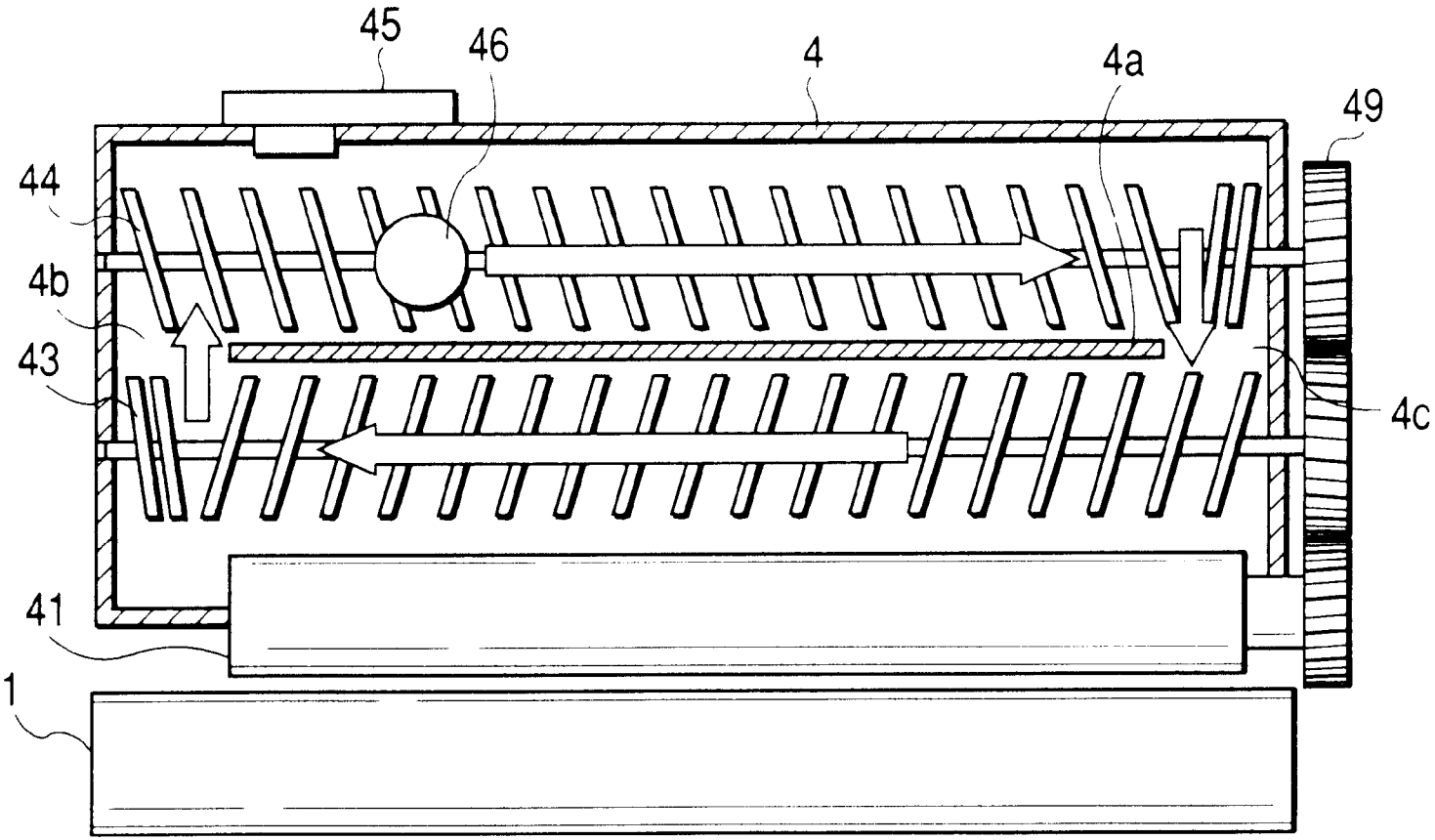
FIG. 3 is an illustration showing the circulation of a developer in the developing device of the process cartridge of FIG. 2.

As shown in FIG. 2, a toner replenishing screw 51 which is a developer replenishing member is provided in the T-CRG 5, and the amount of toner replenishment is controlled by the number of rotations (rotating time) thereof.

Referring again to FIG. 1, the yellow image formed on the photosensitive drum 1 enters the primary transfer nip portion N1 of the intermediate transferring belt 8. At the primary transfer nip portion N1, a flexible electrode 9 is brought into contact with the back side of the intermediate transferring belt 8. A primary transferring bias source 9*a* is connected to the flexible electrode 9 to make a bias independently applicable at each port.

Yellow is first transferred to the intermediate transferring belt 8 at a port for the first color, and then magenta, cyan and black are successively transferred at respective ports from the photosensitive drums 1 corresponding to the respective colors which have been subjected to steps similar to those previously described.

A four-color full color image formed on the intermediate transferring belt 8 is then collectively transferred to a transferring material P fed with timing taken by a pair of registration rollers 12, at a secondary transfer nip portion N2 by a secondary transferring roller 10 opposed to the secondary transferring opposed roller 8*c*, thereby obtaining a color print image fused and fixed by a fixing apparatus, not shown.

Any secondary transfer residual toner remaining on the intermediate transferring belt 8 is subjected to blade-cleaning by an intermediate transferring belt cleaner 11, and the apparatus prepares for the next image forming step.

As the material of the intermediate transferring belt 8, in order to make the registration at the port for each color good, a retractile material is not desirable, but a rubber belt of the resin origin or with a metal core contained therein, or a combination of resin and a rubber belt is desirable.

In the present embodiment, use was made of a resin belt formed of carbon dispersed in PI (polyimide), and controlled to volume resistance of the order of $10^8\Omega$ cm. The thickness of the resin belt is 80 $\mu$m, the longitudinal length thereof is 320 mm, and the full circumference thereof is 900 mm.

Also, as the flexible electrode 9, use was made of carbon-dispersed high density polyethylene having sufficient flexibility and wear resistance and controllable to low resistance. The resistance thereof is $10^4\Omega$ or less, the thickness thereof is 500 $\mu$m and the longitudinal length thereof is 315 mm, and the leak with respect to the photosensitive drums 1 is avoided.

Image forming conditions will hereinafter be described briefly.

On the photosensitive drum dark potential (non-image portion potential by primary charging): Vd=−600 V light potential (non-image portion potential by laser exposure): Vl=−150 V Developing method: two-component magnetic brush developing method Developing bias: Vdc=−400 V Vac=1800 Vpp frequency=2300 Hz Process speed: 117 mm/sec. Primary transferring bias:

1st color+400 V

2nd color+400 V

3rd color+400 V

4th color+400 V

The plain paper throughput of the above-described printer is letter size lateral (216 mm) feeding/24 ppm, and the image interval (sheet interval) is 80 mm.

Now, in FIG. 2, the P-CRG 7 having the photosensitive drum 1, the developing device 4, the charging roller 2 and the cleaner 6 is made into a unit by a cover 71 which is a frame body covering these. The T-CRG 5 and the P-CRG 7 can be inserted into and mounted on predetermined portions in the color laser printer in a predetermined manner by mounting means 60 and 70, respectively, and conversely can be taken out of the predetermined mounting portions.

The T-CRG 5 is provided with memory means 20, and the amount of remaining toner in the T-CRG 5 can be calculated by the used amount information of the T-CRG 5, and the user can be sequentially informed of the life of the T-CRG 5.

As the memory means 20 used in the present invention, there is no particular limitation if it is one rewritably storing and holding signal information therein, and use is made, for example, of electrical memory means such as a RAM or a ROM capable of rewriting, or magnetic memory means such as a magnetic memory medium, a magnetic bubble memory or a magneto-optical memory.

A construction concerned in the communication between the memory means 20 used in the present embodiment and the main body side of the image forming apparatus will hereinafter be schematically described with reference to FIG. 4.

Figure 4:
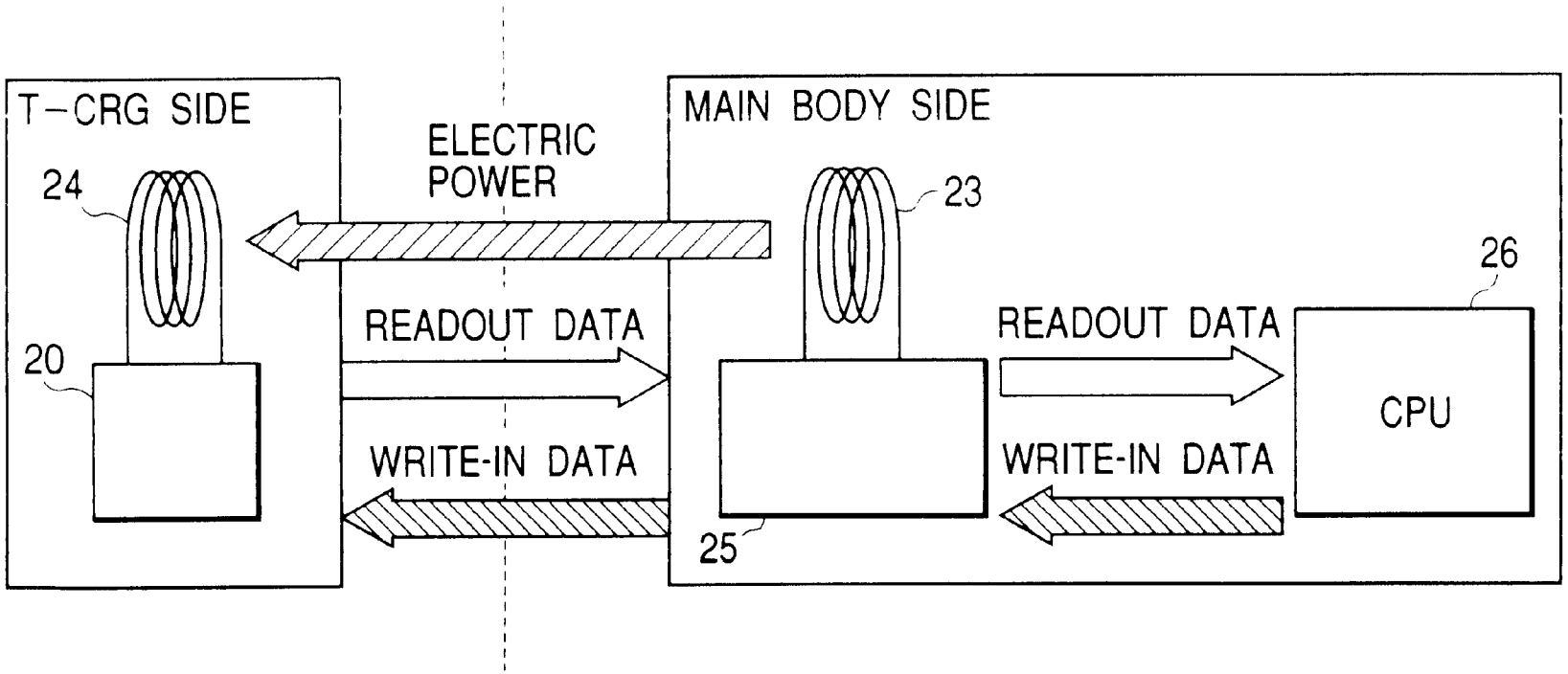
FIG. 4 is an illustration showing the construction of the communication between the main body side of an apparatus according to an embodiment of the present invention and a non-contact memory on the process cartridge side or the toner supplying unit side.

As shown in FIG. 4, an antenna 23 and a resonance circuit comprising a capacitor, not shown, are combined together on the main body side of the image forming apparatus, whereby an operation power source is produced from an electromagnetic wave transmitted from a reader writer 25 to an antenna 24 on the T-CRG 5 side. Thereby, a power source is not required on the T-CRG 5 side, and it becomes possible to effect communication.

As described above, the non-volatile memory 20 as memory means is carried in the T-CRG 5. In the present embodiment, a ferroelectric material non-volatile memory (hereinafter referred to as the "FeRAM") 20 was used as a typical one. Data delivered from a main body side CPU 26 is written into the FeRAM 20 by the use of the reader writer 25, and information in the FeRAM 20 is read out and delivered to the main body side CPU 26.

Information as to whether this T-CRG 5 is a new one is stored in the FeRAM 20.

Figure 5:
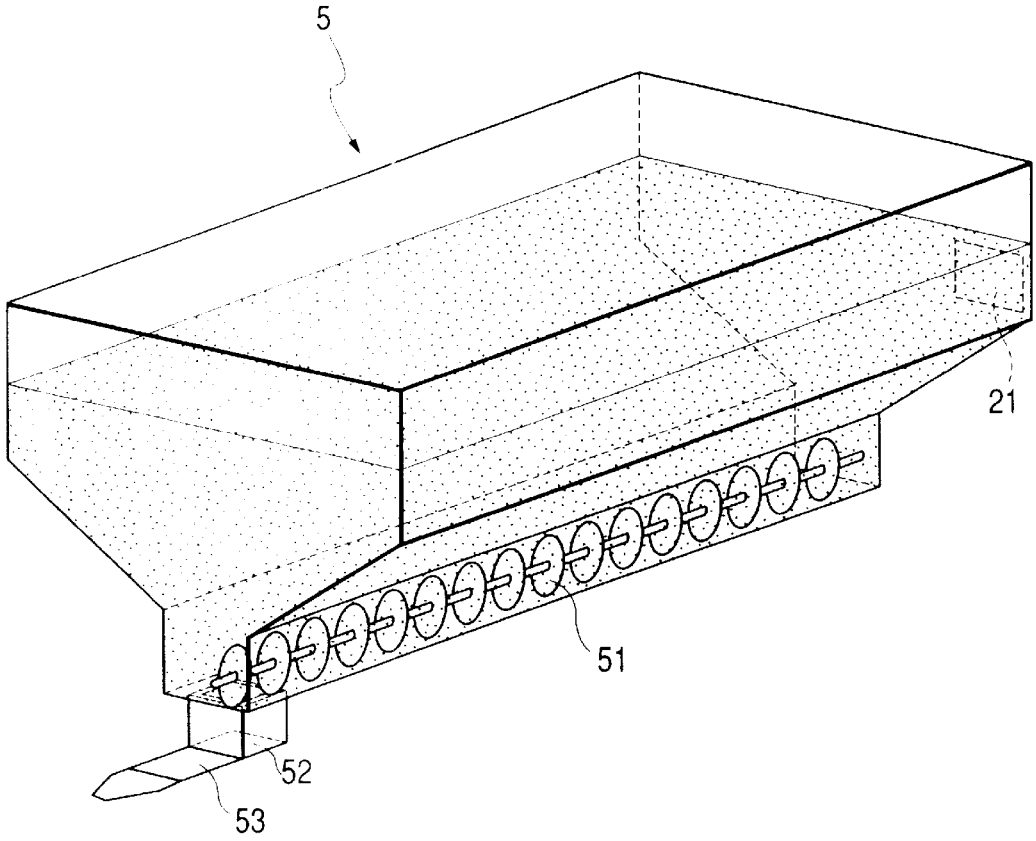
FIG. 5 is a schematic perspective view showing the toner supplying unit according to an embodiment of the present invention.

FIG. 5 shows an enlarged perspective view of the T-CRG 5 which is the developer supplying unit of the present embodiment.

In a state in which the T-CRG 5 is a new one, the user first mounts the T-CRG 5 on the main body of the image forming apparatus, and thereafter pulls out a seal member 53 seating a toner supply port 52 in advance to thereby bring about a state in which the replenishment of the toner supply is possible. Then, a toner replenishing screw 51 is rotated to thereby effect the replenishment of the toner supply. In the present embodiment, as this seal member 53, use is made of one of a type which is adhesively secured to the toner supply port 52 and is pulled out, but use may be made of a seal member assuming such a construction that covers the toner supply port 52 and is moved during use.

Description will now be made of detecting means for detecting information (a parameter) related to the amount of toner in the T-CRG 5 in the present embodiment. If this detecting means is basically of a construction for inferring that the amount of developer (toner) remaining in the T-CRG 5 has assumed a predetermined value or less and detecting a parameter, there is no particular limitation and means of a conventional construction can be used. Specifically, use can be made of means for detecting the electrostatic capacity of the toner, means for detecting the weight of the toner, means of a light transmitting type or the like.

In the present embodiment, the number of rotations of the toner replenishing screw 51 was used as the parameter of the amount of toner in the T-CRG 5.

The T-CRG 5 in the present embodiment can print about 20,000 images (as converted in terms of A4 printing ratio of 5%) by an amount of charge of 600 g. Usually it is controlled so that 300 mg of toner may be supplied to the P-CRG 7 by the toner replenishing screw being rotated for a second. That is, when the toner replenishing screw 51 is rotated for 2,000 sec., the amount of toner remaining in the T-CRG 5 becomes zero.

Figure 6:
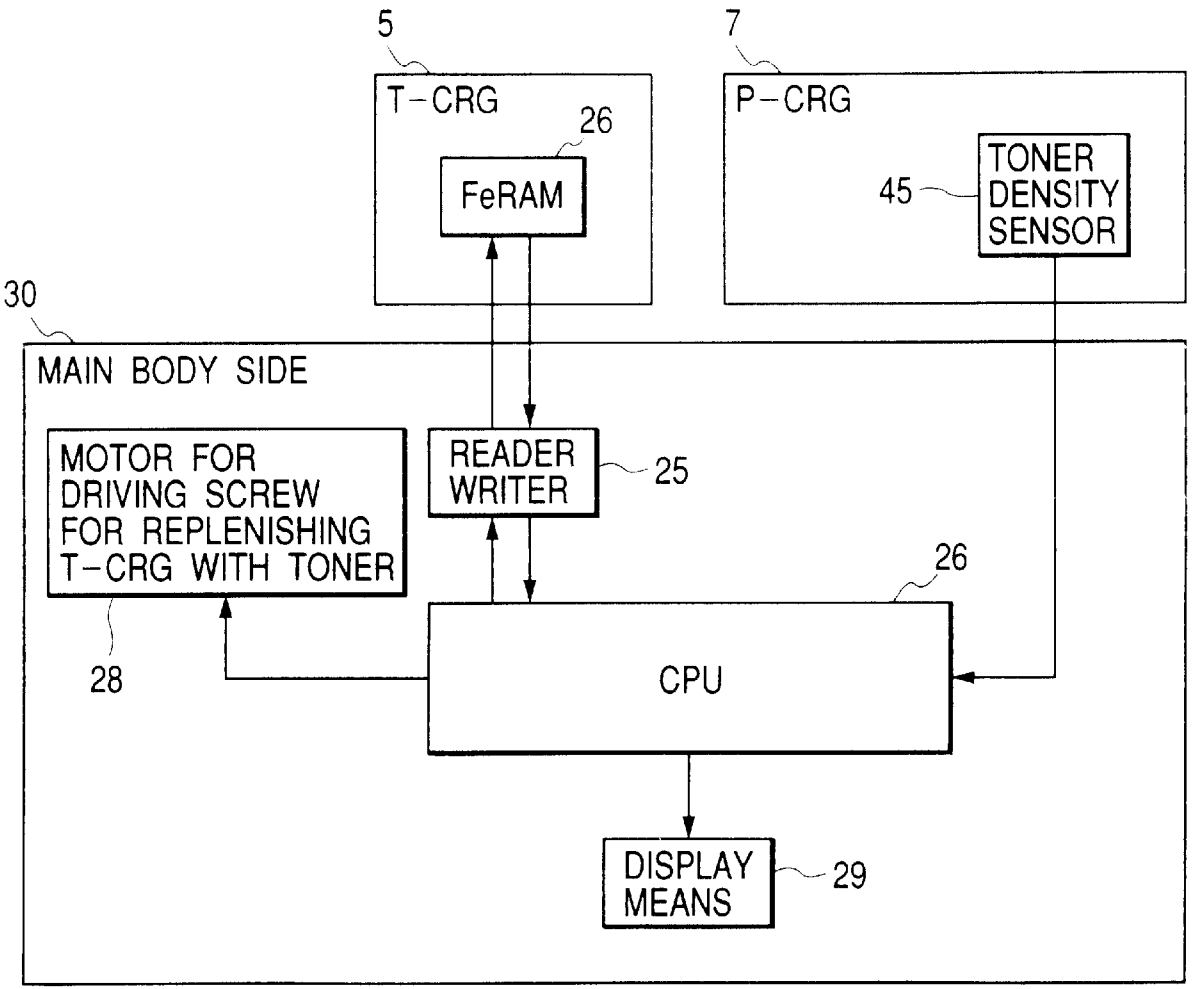
FIG. 6 is a block diagram showing the main body, the process cartridge and the toner supplying unit according to an embodiment of the present invention.

In the block diagram of FIG. 6, when as previously described, it is judged from the result of the detection by the toner density detecting sensor 45 that the density of the toner has assumed a predetermined value or less and the density of the toner is low, a signal is sent to a CPU 26 so as to replenish the toner. In response to the signal, the CPU 26 rotates a motor 28 for driving a screw for replenishing the T-CRG with the toner, thereby replenishing the P-CRG 7 with the toner from the T-CRG 5. The CPU 26 is designed to write the data of the rotating time of the motor 28, i.e., the parameter of the amount of toner, into the FeRAM 20 of the T-CRG 5 at this time by the use of the reader writer 25 for the T-CRG 5. The relation between the rotating time of this screw and the amount of used toner is linear and therefore, it becomes possible to sequentially detect the amount of remaining toner, i.e., the life of the T-CRG 5.

Figure 7:
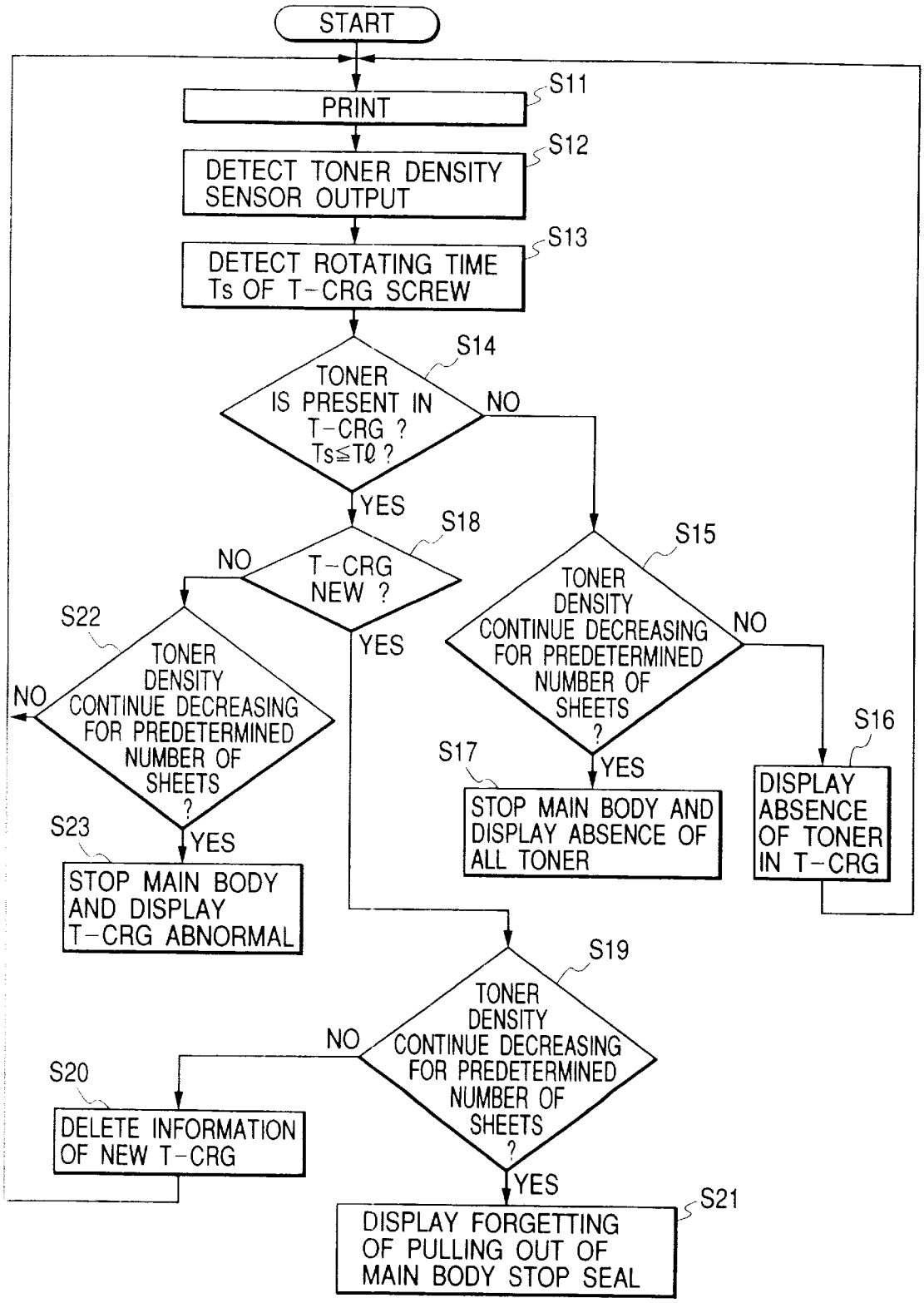
FIG. 7 is a flowchart for judging the state of the toner supplying unit according to an embodiment of the present invention.

FIG. 7 is a flowchart for illustrating a mechanism for judging the state of the T-CRG 5 in the color laser printer of the present embodiment. The flow when judging the state (the used state) of the T-CRG 5 will hereinafter be described with reference to FIG. 7.

First, the printing operation of the main body 30 of the image forming apparatus on which the T-CRG 5 and the P-CRG 7 have been mounted is started (S11). The then output of the toner density sensor 45 of the developing device 4 is detected, and the result of the detection is written into a memory (not shown) included in the CPU 26 of the main body 30 of the apparatus (S12). Further, the rotating time Ts of the screw of the T-CRG 5 (the rotating time data of the motor 28) is detected, and is integrated into the FeRAM 20 (S13). Then, the rotating time is compared with the rotating time Ti of the screw at which the toner in the T-CRG 5 becomes absent ($Ts \leqq T1$), thereby judging whether-the toner is present in the T-CRG 5 (S14). The program is divided from here into various cases which will hereinafter be described.

(1) When it is judged that the toner is absent in the T-CRG 5:

The judgment of the absence of the toner is set to the timing at which the toner becomes completely absent under the condition of the highest toner replenishing ability, actually including irregularity. Accordingly, there is a case where some toner remains in the T-CRG 5 even if it is judged that the toner is absent therein, and actually there is a case where the replenishment of the toner supply is still effected. So, further the toner density detection data by the toner density sensor 45 is detected during each cycle of printing. From this detection data, whether the toner density has continued to decrease for a predetermined number of sheets is judged (S15), and (1)-1 when the toner density has not continued to decrease, the display of the "absence of the toner in the T-CRG" is effected by display means 29, and return is made to the printing operation (S16). That is, it is judged that a slight amount of toner is still present in the T-CRG 5, and the main body 30 is not stopped.

(1)-2 When the density of the toner has continued to decrease for the predetermined number of sheets, the toner is completely absent in the T-CRG 5 and the density of the toner in the P-CRG 7 has decreased and therefore, the main body 30 is stopped and the display of "the absence of all toner" is effected (S17).

(2) When it is judged that the toner is present in the T-CRT 5:

First, whether the T-CRG 5 is new is judged from the information of FeRAM 20 (S18).

(2)-1 When the T-CRG 5 is new, the toner density detection data by the toner density sensor 45 is detected during each cycle of printing. From this detected data, whether the density of the toner has continued to decrease for the predetermined number of sheets is judged (S19), (2)-1- and when the density of the toner has not continued to decrease, the information of a new T-CRG written in the FeRAM 20 of the T-CRG 5 is deleted, and return is made to the printing operation (S20). That is, it is judged that the T-CRG 5 is normally used.

(2)-1-2 When the density of the toner has continued to decrease for the predetermined number of sheets, it means that the user has forgotten to pull out the seal number 53 and therefore, the operation of the main body is stopped and the "forgetting of pulling out the seal" is displayed on the display means 29 (S21).

(2)-2 Again when the T-CRG 5 is not new, the toner density detection data by the toner density sensor 45 is detected during each cycle of printing. From this detected data, whether the density of the toner has continued to decrease for the predetermined number of sheets is judged (S22).

(2)-2-1 and when the density of the toner has not continued to decrease, return is made to the printing operation.

(2)-2-2 When the density of the toner has continued to decrease for the predetermined number of sheets, it means the abnormality of the toner supplying portion of the T-CRG 5 and therefore, the operation of the main body is stopped, and "T-CRG abnormal" is displayed on the display means 29 (S23).

As described above, whether the T-CRG 5 is new or old can be judged by the detection of the parameter of the amount of remaining toner in the T-CRG 5 which is the developer supplying unit and the memory 20 carried therein, and in conformity with each case, the user can be delicately informed of the display of the absence of the toner or an abnormal time. For example, when the T-CRG 5 is new, the display of the forgetting of pulling out of the seal or the forgetting of opening of the seal member is effected, and when the T-CRG 5 is old, the display of the trouble of the developer supplying unit is effected to the user. For example, when an old T-CRG 5 has once been detached from the main body and thereafter has been again attached to the main body, it never happens that the main body judges it to be new by mistake.

Further, the detection of the absence of the toner in the T-CRG 5 is effected by not only the means in the T-CRG 5, but the toner density sensor 45 provided in the developing device on the P-CRG 7 side, whereby more delicate display to the user can be effected.

As the result, there can be provided an electrophotographic image forming apparatus and a developer supplying unit which are very useful to the user.

Also, the process cartridge refers to at least one of charging means, developing means and cleaning means and an electrophotographic photosensitive body integrally made into a cartridge which is detachably attachable to the main body of an image forming apparatus.

Also, the developer supplying unit refers to an apparatus for supplying the developer to the developing device in the process cartridge, and detachably attachable to the main body of the image forming apparatus.

What is claimed is:

1. An image forming apparatus comprising:

a developing device for developing an electrostatic image formed on an image bearing member by a developer;

a developer supplying unit detachably attachable to a main body of said image forming apparatus for supplying the developer to said developing device;

density detecting means for detecting a density of the developer in said developing device; and developer remaining amount detecting means for detecting information regarding a remaining amount of the developer in said developer supplying unit;

a state of said developer supplying unit being judged on the basis of a result of the detection by said density detecting means and a result of the detection by said developer remaining amount detecting means, wherein said developer supplying unit is provided with a supply port for supplying the developer to said developing device therethrough, and a seal member for openably sealing said supply port, and when it is judged from the result of the detection by said developer remaining amount detecting means that the amount of the developer in said developer supplying unit exceeds a predetermined value and said developer supplying unit is a new condition and it is detected from the result of the detection by said density detecting means that the density of the developer is lower than a predetermined value, it is judged that opening of said seal member has not been effected.

2. An image forming apparatus according to claim 1, wherein when it is judged from the result of the detection by said developer remaining amount second detecting means that the unit exceeds a predetermined value and it is detected from the result of the detection by said density detecting means that the density of the developer is lower than a predetermined value, said developer supplying unit is judged to be in an abnormal condition.

3. An image forming apparatus according to claim 1, wherein a seal member for openably sealing said supply port, and when said developer supplying unit is in a new condition and it is detected from the result of the detection by said density detecting means that the density of the developer is lower than a predetermined value, said developer supplying unit is judged to be in an abnormal condition.

4. An image forming apparatus comprising:

a developing device for developing an electrostatic image formed on an image bearing member by a developer;

a developer supplying unit detachably attachable to a main body of said image forming apparatus for supplying the developer to said developing device;

density detecting means for detecting a density of the developer in said developing device; and developer remaining amount detecting means for detecting information regarding a remaining amount of the developer in said developer supplying unit;

a state of said developer supplying unit being judged on the basis of a result of the detection by said density detecting means and a result of the detection by said developer remaining amount detecting means, wherein said developer supplying unit is provided with a supply port for supplying the developer to said developing device therethrough, and a seal member for openably sealing said supply port, and when it is judged from the result of the detection by said developer remaining amount detecting means that the remaining amount of the developer in said developer supplying unit exceeds a predetermined value and it is detected from the result of the detection by said density detecting means that the density of the developer is lower than a predetermined value, it is judged that the opening of said seal member has not been effected.

5. An image forming apparatus according to claim 1, wherein when it is judged from the result of the detection by said developer remaining amount detecting means that the remaining amount of the developer in said developer supplying unit is not more than a predetermined value, it is judged that the developer is absent in said developer supplying unit.

6. An image forming apparatus according to claim 1, wherein when it is judged from the result of the detection by said developer remaining amount detecting means that the remaining amount of developer in said developer supplying unit is not more than a predetermined value, said main body of said image forming apparatus is given different information in conformity with whether it has been detected from the result of the detection by the density detecting means that said density of the developer is lower than a predetermined value.

7. An image forming apparatus according to claim 1, wherein said developer supplying unit is provided with storing means for storing therein use information regarding said developer supplying unit, and it is possible to write and read out said information with respect to said storing means from said main body of said image forming apparatus.

8. An image forming apparatus according to claim 1, wherein said developer supplying unit is provided with storing means for storing therein information as to whether said developer supplying unit is in a new condition, and said information stored by said storing means is judged by said main body of said image forming apparatus.

9. An image forming apparatus according to claim 7 or 8, wherein the state of said developer supplying unit is judged on the basis of said information stored by said storing means and the result of the detection by said density detecting means.

10. An image forming apparatus according to claim 8, wherein when the information that said developer supplying unit is in a new condition is stored by said storing means and it has not been detected from the result of the detection by said density detecting means that said density of the developer is lower than a predetermined value, the information that said developer supplying unit is in a new condition stored by said storing means is deleted.

11. An image forming apparatus according to claim 9, wherein when it is judged from the result of the detection by said second detecting means that the remaining amount of the developer in said developer supplying unit exceeds a predetermined value and the information that said developer supplying unit is in a new condition is stored by said storing means and it is detected from the result of the detection by said density detecting means that said density of the developer is lower than a predetermined value, it is judged that opening of said seal member has not been effected.

12. An image forming apparatus according to claim 1, wherein said main body of said image forming apparatus includes informing means for providing information regarding the state of said developer supplying unit.

13. An image forming apparatus according to claim 1, wherein said developing device is provided in a cartridge detachably attachable to said main body of said image forming apparatus.

14. An image forming apparatus according to claim 13, wherein said cartridge is provided with said image bearing member.

15. An image forming apparatus according to claim 1, wherein said developer includes a toner and a carrier.

16. An image forming apparatus comprising:

a developing device for developing an electrostatic image formed on an image bearing member by a developer;

a developer supplying unit detachably attachable to a main body of said image forming apparatus for supplying the developer to said developing device, said developer supplying unit being provided with storing means for storing therein information as to whether said developer supplying unit is in a new condition; and density detecting means for detecting a density of the developer in said developing device; and developer remaining amount detecting means for detecting information regarding an amount of the developer in said developer supplying unit;

a state of said developer supplying unit being judged on the basis of a result of the detection by said density detecting means, a result of the detection by said developer remaining amount detecting means, and the information stored by said storing means.

17. An image forming apparatus according to claim 16, wherein when the information that said developer supplying unit is in a new condition is not stored by said storing means and it is detected from the result of the detection by said density detecting means that said density of the developer is lower than a predetermined value, said developer supplying unit is judged to be abnormal.

18. An image forming apparatus according to claim 16, wherein said developer supplying unit is provided with a supply port for supplying the developer to said developing device therethrough, and a seal member for openably sealing said supply port, and when the information that said developer supplying unit is in a new condition is stored by said storing means and it is detected from the result of the detection by said density detecting means that said density of the developer is lower than a predetermined value, it is judged that opening of said seal member has not been effected.

19. An image forming apparatus according to claim 16, wherein when it is judged from the result of the detection by said developer remaining amount detecting means that the amount of the developer in said developer supplying unit exceeds a predetermined value, it is judged whether the information stored by said storing means is that said developer supplying unit is in a new condition.

20. An image forming apparatus according to claim 16, wherein it is possible to write and read out said information with respect to said storing means from said main body of said image forming apparatus.

21. An image forming apparatus according to claim 16, wherein when the information that said developer supplying unit is in a new condition is stored by said storing means and it has not been detected from the result of the detection by said density detecting means that said density of the developer is lower than a predetermined value, the information that said developer supplying unit is new stored by said storing means is deleted.

22. An image forming apparatus according to claim 16, wherein said main body of said image forming apparatus includes informing means for providing information regarding the state of said developer supplying unit.

23. An image forming apparatus according to claim 16, wherein said developing device is provided in a cartridge detachably attachable to said main body of said image forming apparatus.

24. An image forming apparatus according to claim 23, wherein said cartridge is provided with said image bearing member.

25. An image forming apparatus according to claim 16, wherein said developer includes a toner and a carrier.

26. An image forming apparatus according to claim 16, wherein when it is judged from the result of the detection by said developer remaining amount detecting means that the remaining amount of the developer in said developer supplying unit exceeds a predetermined value, the information that said developer supplying unit is in a new condition is not stored by said storing means, and it is judged from the result of the detection by said density detecting means that said density of the developer is lower than a predetermined value, said developer supplying unit is judged to be in an abnormal condition.

27. An image forming apparatus according to claim 16, wherein when it is judged from the result of the detection by said developer remaining amount detecting means that the remaining amount of the developer in said developer supplying unit exceeds a predetermined value, the information that said developer supplying unit is in a new condition is stored by said storing means, and it is not judged from the result of the detection by said density detecting means that said density of the developer is lower than a predetermined value, the information, stored by said storing means, that said developer supplying unit is in a new condition is deleted.

28. An image forming apparatus according to claim 16, wherein the information regarding the remaining amount of the developer, which is detected by said developer remaining amount detecting means, is stored by said storing means.

29. An image forming apparatus according to claim 25, wherein said density detecting means includes a sensor for detecting a permeability of the developer.

30. An image forming apparatus according to claim 16, wherein said developer supplying unit includes a rotatable screw for supplying the developer to said developing device, and wherein the information regarding the remaining amount of the developer is a number of rotations of said screw.

* * * * *

UNITED STATES PATENT AND TRADEMARK OFFICE

CERTIFICATE OF CORRECTION

PATENT NO. : 6,381,419 B1 
DATED : April 30, 2002
INVENTOR(S) : Masahide Kinoshita et al.

It is certified that error appears in the above-identified patent and that said Letters Patent is hereby corrected as shown below:

Column 5,
Line 56, “Developing” should read -- ¶Developing --;
Line 57, “Devel-” should read -- ¶Devel- --; and
Line 59, “Process” should read -- ¶Process -- and “Primary” should read -- ¶Primary --.

Column 7,
Line 45, “whether-the” should read -- whether the --.

Column 8,
Line 32, “and” should read -- And --.

Column 9,
Line 44, “a seal member for openably sealing said supply” should be deleted; and
Line 45, “port, and” should be deleted.

Signed and Sealed this

Twelfth Day of November, 2002

*Attest:*

*Attesting Officer*

JAMES E. ROGAN
*Director of the United States Patent and Trademark Office*